United States Patent [19]

Bright et al.

[11] 3,969,043

[45] July 13, 1976

[54] PROCESS COOLED SUBMERSIBLE PUMP AND MOTOR ASSEMBLY

[75] Inventors: Hugh H. Bright, Oklahoma City; Lee W. Davis, Del City; Frank J. Stanaszek, Bethany, all of Okla.

[73] Assignee: Little Giant Corporation, Oklahoma City, Okla.

[22] Filed: Mar. 25, 1974

[21] Appl. No.: 454,254

Related U.S. Application Data

[63] Continuation-in-part of Ser. No. 430,657, Jan. 4, 1974, abandoned.

[52] U.S. Cl. ..... 417/366; 415/214; 417/423 R; 310/54; 310/63

[51] Int. Cl.[2] ..... F04B 39/06

[58] Field of Search ..... 415/201, 214, 219; 417/423, 424, 366, 372, 368; 310/62, 63, 64, 54, 58, 59, 87

[56] References Cited

UNITED STATES PATENTS

| | | | |
|---|---|---|---|
| 1,269,909 | 6/1918 | Cooper | 417/366 |
| 3,074,349 | 1/1963 | Zimmermann | 417/423 R |
| 3,119,342 | 1/1964 | White | 417/423 R |
| 3,170,407 | 2/1965 | Johnson | 417/423 R |
| 3,264,999 | 8/1966 | Tutthill | 417/424 |
| 3,408,942 | 11/1968 | Davenport et al. | 417/424 |
| 3,495,538 | 2/1970 | Kruckeberg | 417/372 |
| 3,502,030 | 3/1970 | Bukewihge et al. | 417/423 R |
| 3,576,380 | 4/1971 | Sargeant | 417/423 R |
| 3,791,773 | 2/1974 | Maginnis | 417/423 R |
| 3,819,293 | 6/1974 | Zitzmann | 415/214 |

*Primary Examiner*—C. J. Husar
*Attorney, Agent, or Firm*—Dunlap, Codding & McCarthy

[57] ABSTRACT

A submersible pump having a volume chamber with a volute wall integrally formed with and extending internally to a hermetically sealed housing. A fixed bearing is pressed in the interior wall of the volume chamber and is so established to determine the axial alignment of a drive shaft passing therethrough. The drive shaft is also supported by a self-aligning bearing disposed within the housing. An impeller, disposed within the volume chamber, is connected to the drive shaft. A drive motor enclosed in the housing rotates the drive shaft and the impeller, the motor being surrounded by a coolant fluid therein. Inlet and outlet ports are provided to complete the pump. As the impeller is rotated to pump a process fluid, the coolant fluid in the housing serves to lubricate the bearings and to effect heat transfer from the motor and bearings through the walls of the volume chamber to the process fluid. One embodiment of the present invention provides a submersible pump and motor assembly that is insulated in a manner that assures complete electrical integrity of the assembly.

23 Claims, 11 Drawing Figures

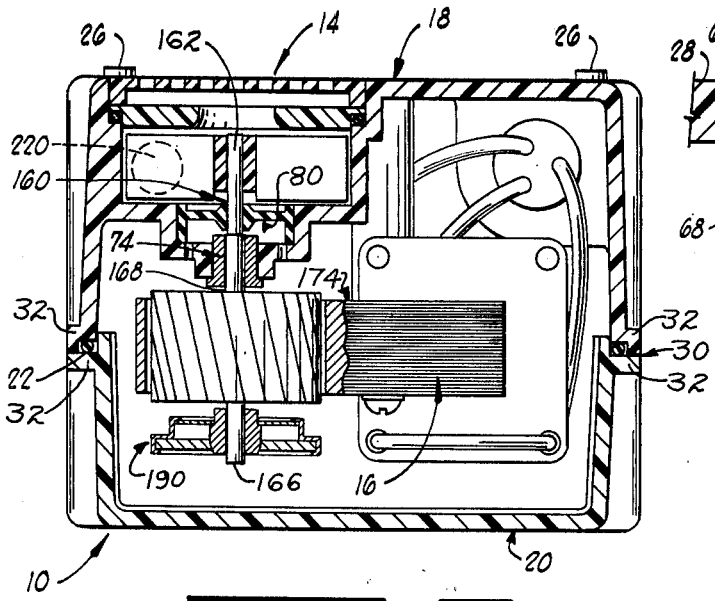
FIG. 3
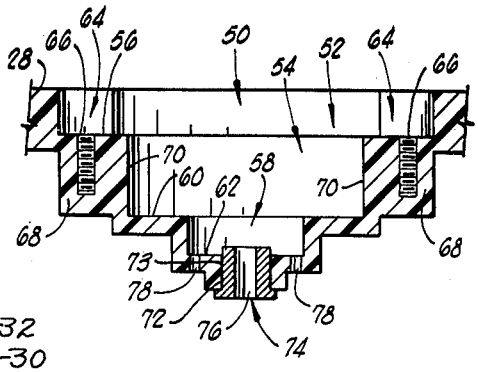
FIG. 4A
FIG. 4
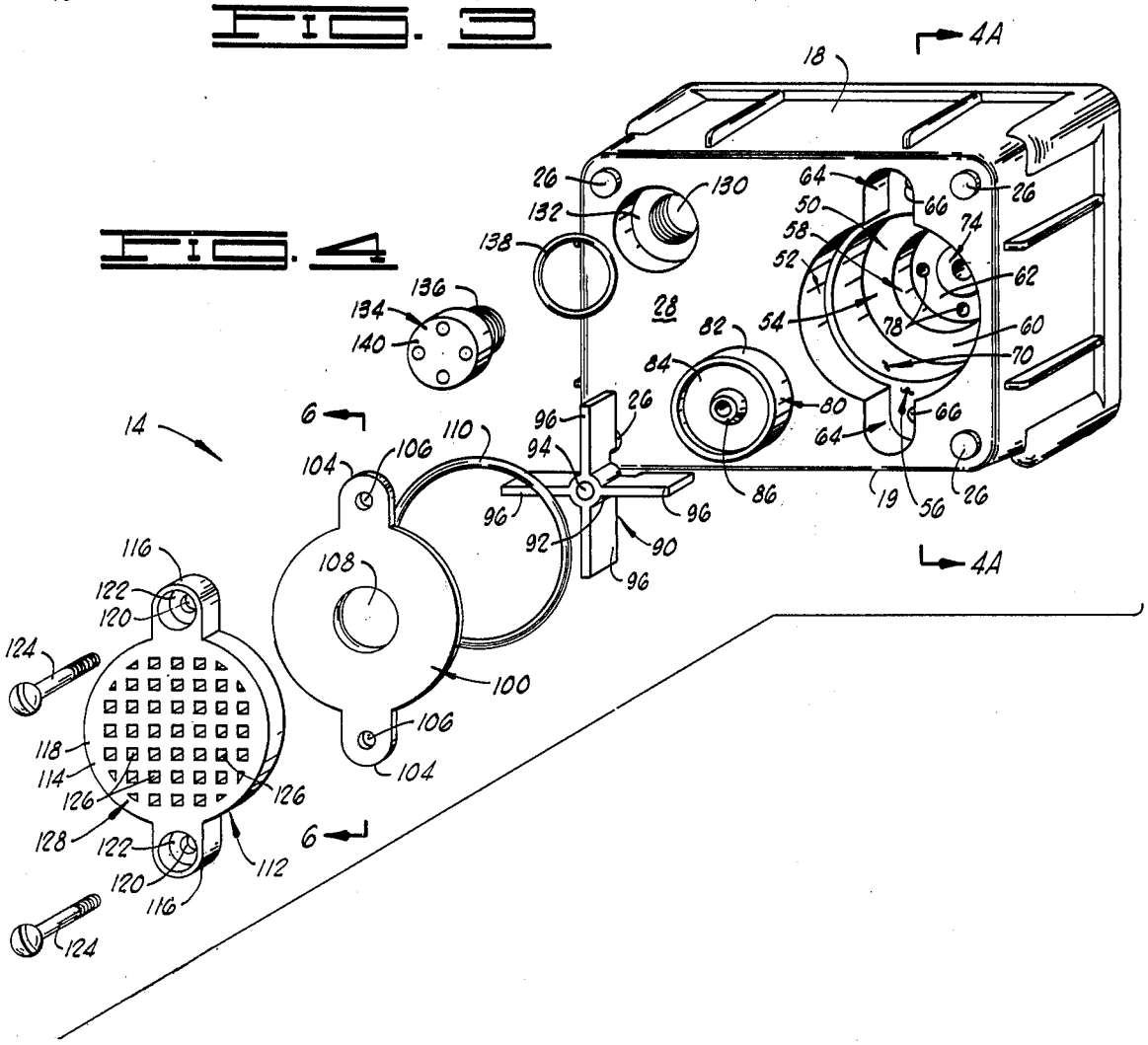

PROCESS COOLED SUBMERSIBLE PUMP AND MOTOR ASSEMBLY

CROSS-REFERENCE TO RELATED APPLICATION

This application is a continuation-in-part of United States Patent Application No. 430,657, filed Jan. 4, 1974, now abandoned.

BACKGROUND OF THE INVENTION

1. Field of the Invention

The present invention relates generally to pumps and more particularly, but not by way of limitation, to an improved submersible pump.

2. Description of the Prior Art

There is a market in this country and abroad for submersible pumps that are efficient, lightweight, and inexpensive to manufacture. A pump manufactured for submersion in process fluids must be protected from the environment in which it operates, such as when it is submersed in water or other corrosive fluids. Also, it should have good moisture stability. Pumps that meet such service requirements are usually integrally self-contained; that is, they are driven by enclosed motors sealed for environmental protection.

In addition to these demanding requirements, there is the general problem of making submersible pumps at reasonable cost. As usually found in manufacturing processes, secondary operations involved in the making of component parts, such as drilling and tapping holes, add large labor and overhead economic burdens. Especially bothersome in the making of pumps has been the alignment problems encountered during assembly operations. It is not unusual during the assembly of pump components for trained personnel to press, shave, strike, and otherwise adjust component parts so as to obtain proper adjustment for each individual pump. This is not only time consuming, it also introduces variations in pump operation due to the component tolerances summing to give a wider span of operating performance, thereby making prediction of pump performance more difficult.

Another problem encountered in submersible pumps is heat buildup due to the enclosed motor as well as from the friction of bearing surfaces. This heat may affect operating characteristics as well as shorten the effective operating life of the pump and motor assembly. Therefore, the heat created by the working parts of a submersible pump must be removed to give stable and safe operation.

Another problem that presents itself with submersible pumps is that of maintaining the exterior surfaces so that the pump retains its appearance. In a consumer market, color often becomes a decisive factor and, accordingly, submersible pumps must be designed with that in mind. Generally speaking, painted surfaces have not always succeeded in such service, and a good paint coating that will meet the rigorous test of endurance is an expensive ingredient in the manufacture of submersible pumps.

In addition to the above, there is a need for submersible pumps to be constructed in a manner that assures complete electrical integrity; that is, submersible pumps should be constructed with the advantages of the best features of grounding and, preferably, constructed in compliance with the double insulation principle. As to the latter, this refers to the technique of insulating each part of the assembly from the electrical motor such that the motor is completely isolated electrically and, further, each potential conductor is insulated. This requirement for submersible pumps has arisen from the experience of electrical shorting whenever portions of electrical insulation are broken down due to wear, fatigue or the like, whereupon electrical leakage has occurred. Of course, in the case of submersible pumps, the danger presented from such electrical leakage is increased by the possibility of conducting such leakage through the submerging fluid.

SUMMARY OF INVENTION

The present invention is directed to a submersible pump that has a volume chamber integrally formed with the housing and which extends into the elastomeric housing. The chamber has a heat conducting volute wall and interior wall, the latter having a fixed bearing molded into it so as to establish a true axial alignment. A second self-adjusting bearing is established by screw mounts distal to and in axial alignment with the fixed bearing. A drive shaft extends through the two bearings.

An impeller is disposed within the volume chamber and is attached to the drive shaft. An electric motor, enclosed in the housing, rotates the drive shaft and, consequently, the impeller. The housing is hermetically sealed and filled so as to be internally flooded with a dielectric, coolant fluid which also serves as a lubricant.

Seal means sealingly engage the drive shaft at a point adjacent to the interior wall of the volume chamber and effects a seal so as to prevent the coolant fluid from entering the volume chamber, and thereby polluting the process fluid being pumped.

Inlet and outlet ports are established relative to the volume chamber. An inlet port feeds process fluid to the volume chamber at a point near the axial center of the impeller, and the outlet port permits process fluid withdrawal at a point removed from the inlet port as, for example, tangentially to the volute wall.

Means is provided to substantially surround both the fixed bearing and the adjusting bearing with coolant fluid so as to lubricate and cool all bearing surfaces. Also, since the volume chamber walls are internally extending to the housing, the walls are continuously contacted by the coolant fluid. The volume chambmer thus provides a heat sink, the heat generated from the pump and motor being transferred to the high velocity process fluid being pumped.

An alternate embodiment of the present invention is provided wherein the pump and motor assembly is insulated in a manner that isolates each potential conductor, thereby guaranteeing the maintenance of electrical integrity throughout the life of the assembly.

An object of the present invention is to provide a submersible pump and motor assembly that provides improved component alignment.

Another object of the present invention is to provide a submersible pump and motor assembly that requires minimum time and skill to assemble, but that has precision quality of operation.

Another object of the present invention is to provide a submersible pump that requires little or no secondary operations to manufacture with the exception of the assembly thereof.

Another object of the present invention is to provide a submersible pump and motor assembly that has a good surface appearance without the requirement of external surface treatment, and which maintains such appearance during its operating life.

Another object of the present invention is to provide a submersible pump and motor assembly that will be available at a very low manufacturing cost and require a minimum of maintenance, while achieving superior pump and motor life.

Another object of the present invention is to provide an integral submersible pump and motor assembly that utilizes pumped process fluid as a heat sink for removing the heat generated by the motor and bearing surfaces.

Another object of the present invention is to provide a submersible pump and motor assembly that maximizes the heat transfer to the pumped process fluid by effecting heat transfer to a high velocity liquid.

Another object of the present invention is to provide a submersible pump that combines a material of construction and design that affords a moldable assembly having high resistance to heat, chemical reaction and moisture, while at the same time affording precision manufacture of component parts which lead to improved pump and motor performance.

Another object of the present invention is to provide a submersible pump and motor assembly that combines a material of construction and design that affords an assembly having maximum electrical integrity such that all component parts thereof are fully and independently insulated electrically.

Other objects and advantages of the present invention will be apparent from the following detailed description when read in conjunction with the accompanying drawings.

BRIEF DESCRIPTION OF THE DRAWINGS

FIg. 3 is ia cross-sectional view taken at 3—3 of FIG. 2.

FIG. 4 is a perspective, exploded view of the pump assembly and housing cover of the present invention.

FIG. 4A is a cross-sectional view of the volume chamber taken at 4A—4A in FIG. 4.

DESCRIPTION OF THE EMBODIMENT OF FIG. 1 THROUGH FIG. 8

Figure 1:
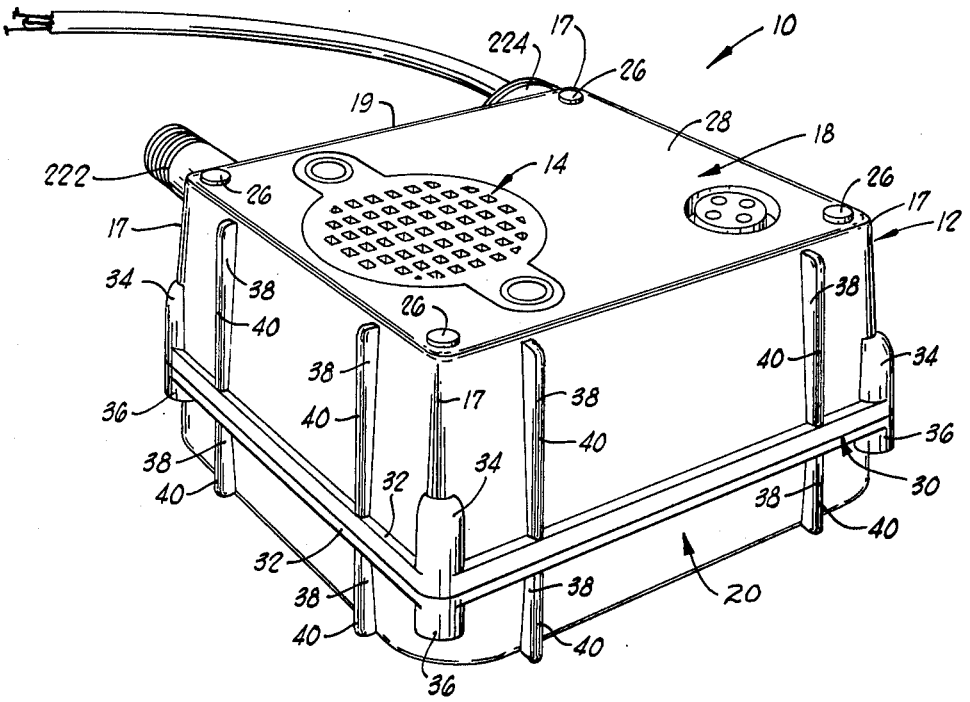
FIG. 1 is a perspective view of the pump and motor assembly of the present invention.
Figure 2:
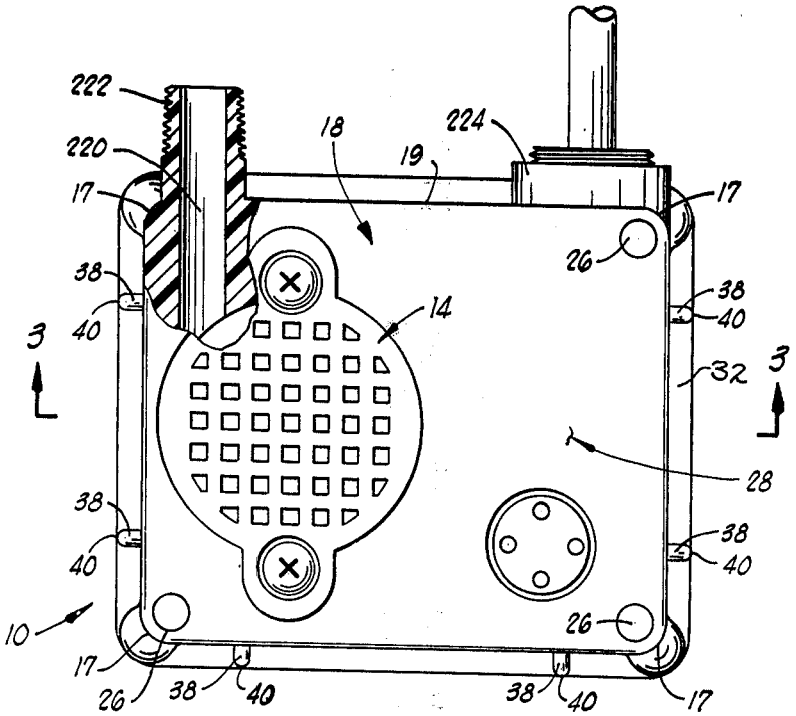
FIG. 2 is a plan view of the pump and motor assembly of the present invention, and has a partial cutaway view.

Referring now to the drawings, and particularly to FIGS. 1 through 3, the submersible pump and motor assembly of the present invention is generally designated by the numeral 10, and comprises housing assembly 12, pump assembly 14, and electric motor assembly 16.

Figure 5:
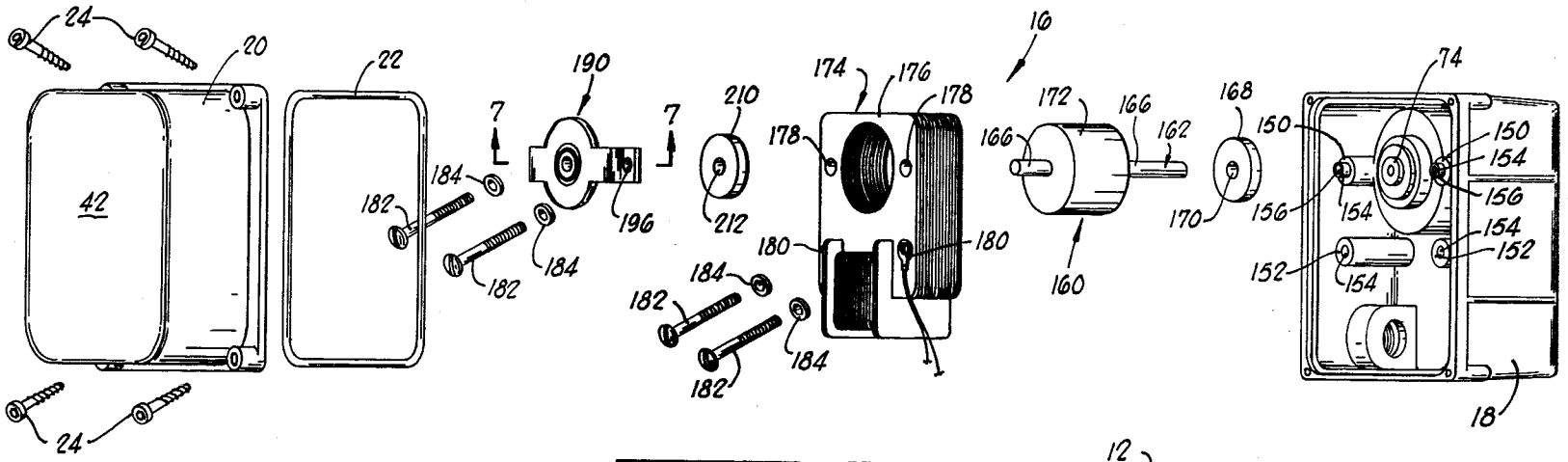
FIG. 5 is a perspective, exploded view of the components contained within the housing assembly of the present invention.

The housing assembly 12 includes two sections: housing cover 18 and motor cover 20. These covers are generally hollow rectangularly-shaped forms that are designed to join together with interposinng O-ring 22 therebetween, and are then secured by the use of four screws 24, as best seen in FIG. 3 and FIG. 5 the latter figure to be discussed below. The covers 18 and 20 fit together to form a generally hollow, box-like housing assembly 12 shown in FIG. 1.

The housing assembly 12 is molded of a material having a thermal conductivity of at least 1.4 BTU-inch per hour per square foot per degree Fahrenheit. The reason for this will become clearer below under the discussion of heat transfer. A material having good heat transferability has been found to be glass-filled nylon, which also possesses chemical, moisture, and heat resistance properties that serve well in the pump and motor assembly of the present invention. This material has been found to have good dimensional stability and sharp resolution during molding so as to provide practically burr-free edges and sharply-defined threads. This eliminates all but an occasional secondary operation to prepare the molded parts for use. However, this material is given only as an example of one material suitable for molding the housing assembly 12 of the present invention, it being recognized that there are a number of different materials which will be required dependent upon the requirement for the pump and motor assembly.

Continuing to describe the housing assembly 12, it should be noted that posts 26 are provided as molded protrusions from planar surfaces 28 of housing cover 18. The purpose for posts 26, as will be made clear below, is to provide clearance to the pump assembly 14, which is flush to the surface 28, when pump 10 is set upon posts 26. At the joining seam 30 of housing assembly 12, there are mating flanges 32 necessitated by the requirement of strength upon joinder of the housing cover 18 with the motor 20. At each corner 17 of the housing cover 18 and molded as a part thereof is an apertured boss 34. At each corner of motor cover 20 and molded as a part thereof is a sleeve retainer 36 that has an aperture therethrough aligning with the apertured boss 34. Screws 24 pass through the sleeve retainers 36 and are self-tappingly received by the apertured boss 34 to secure the housing assembly 12.

Provided on each of three sides of housing assembly 12 that form the corners 17 are protruding ribs 38, except on wall 19 which will be discussed below. The outer edges 40 for the ribs 38 along a given side of housing assembly 12 are coplanar. This means, when the pump and motor assembly 10 is set upon that side, all of the edges 40 of the protruding ribs 38 will equally touch a planar surface so as to provide a stable support for the present invention. As will become clear below with further description of the pump and the motor assembly 10, protruding ribs need not be provided for one side of the apparatus because of the conduits leading to that side.

Referring to FIG. 5, the surface 42 of the motor cover 20 is a planar surface for the purpose of permitting pump and motor assembly 10 to be set thereon.

Turning now to a description of pump assembly 14, this can best be seen from FIG. 4. Connected to the planar surface 28 of housing cover 18 is a volume chamber 50 recessed or extending into the housing cover 18. For manufacturing convenience, this chamber 50 is molded as an integral part at the same time that the housing cover 18 is molded. The volume chamber 50 can best be described by referring to FIG. 4A which is a cross-section of the chamber taken at 4A—4A in FIG. 4. Generally speaking, the volume chamber 50 has the appearance of telescoping cylinders that are recessed from surface 28 into housing cover 18. That is, chamber 50 is comprised of a first cylinder chamber 52, the walls of which adjoin surface 28. Coaxial therewith and connected to the first cylindrical chamber 52 is a second cylindrical chamber 54, having a planar surface 56 which is connected to the walls of the first cylindrical chamber 52. Next, there is a third cylindrical chamber 58 coaxial with the first and second cylindrical chambers and further extended therefrom and connected thereto by the planar surface 60 which connects the peripheral edges of the second and third cylindrical chambers. The third cylindrical chamber 58 is sealed at its end opposite to the end attaching to planar surface 60 by a wall member 62 that is normal to the third cylindrical chamber 58.

Returning to a description of the first cylindrical chamber 52 which is connected to surface 28, adjoined thereto are two ear recesses 64, formed by the walls of the first cylindrical chamber 52 extending therefrom and the planar surface 56 which also extends so as to continuously meet the walls of the first cylindrical chamber 52. This then gives the appearance of an internally extending cylindrical chamber 52 from surface 28 having the two recess ears 64 as shown in FIG. 4. There are two molded apertures 66 located through the planar surface 56 and projecting into the molded wall of the second cylindrical chamber 52, as best may be seen in FIG. 4A. These are established to receive self-threading screws, as will be described later, and the plastic mold is designed to provide more bulk to the external surface 68 so as to provide adequate material volume around these apertures 66 which extend for a distance and are bottomed as shown in FIG. 4A.

The wall 70 of the second cylindrical chamber 54 forms the volute for the volume chamber 50. The planar surface 60, the third cylindrical chamber 58, and the end member 62 form an interior wall which seals the second cylindrical chamber 54 on one end. The end member 62 has an aperture 72 formed about the outer edge 73 of the flanged bearing 74. This bearing 74 may be established at the time of molding; that is, it is set in place within the mold cavity that forms volume chamber 50 together with housing cover 18 and is therefore anchored and permanently adjoined to end member 62. In the embodiment shown, this bearing 74 is pressed into aperture 72 following the molding process of housing cover 18 and volume chamber 50, so as to maintain the axial alignment coincident with the axial centers of the above-described first, second, and third cylindrical chambers. The bearing 74 has an aperture 76 therethrough which establishes the alignment of the drive shaft as will be made clear below, and it has therefore been found that the internal diameter of aperture 76 should be maintained within plus or minus 5/10,000ths of an inch. While there are a number of materials that may be used to fabricate bearing 74, it has been found that self-lubricating sintered bronze provides an adequate material for this use.

The end member 62 has four apertures 78 equally spaced about bearing 74, providing fluid communication between the third cylindrical chamber 58 and the interior of housing cover 18.

Turning now to a description of the component parts that complete the pump assembly 14, attention is directed to the exploded view of FIG. 4. A description of these parts will first be given, followed by a discussion of how they are assembled into volume chamber 50. Commencing with the seal 80, this is a shaft seal which is commonly known and which is comprised of a steel ring member 82 with a rubber-like transverse member 84 attached thereto and which necks down to form an expandable seal annulus 86. A suitable material for the transverse member 84 is Viton, a fluoroelastomer made by E. I. du Pont de Nemours & Company, Wilmington, Delaware. The circular ring 82 is sized to pressingly fit within the third cylindrical chamber 58 of volume chamber 50.

The impeller 90 has a cylindrical post 92 that has an aperture 94 longitudinally therethrough. Attached to the outer edges of post 92 are four laterally extending blades 96. The impeller 90 is sized so as to rotatingly occupy the second cylindrical chamber 54 of volume chamber 50, such that the impeller blades are displaced from the volute wall 70 by approximately 1/16th of an inch when the impeller is axially aligned with the center of the second cylindrical chamber 54.

Figure 6:
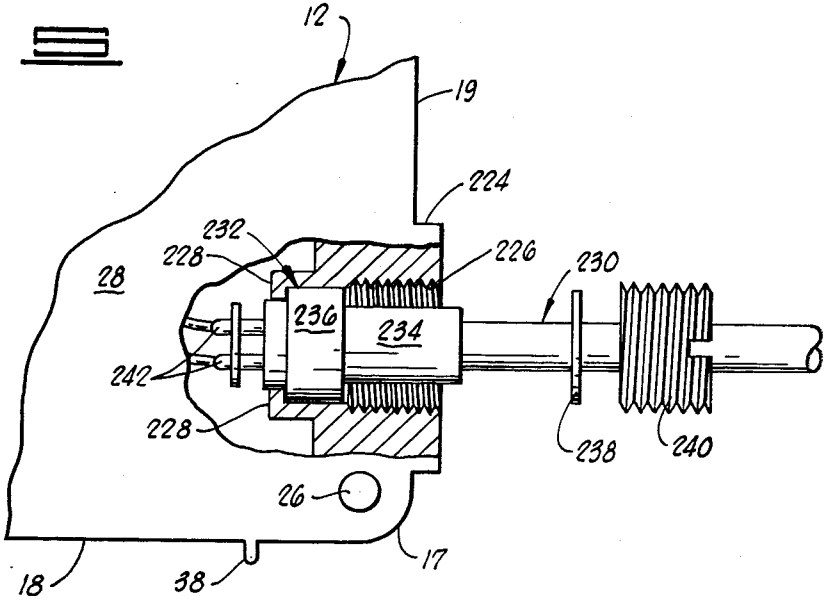
FIG. 6 is a cross-section taken at 6—6 in FIG. 4.

The volute plate 100, shown in FIGS. 4 and 6, is a wafer-shaped plate that fits into the first cylindrical chamber 52 and has a lip portion 102 which is shaped to project into the second cylindrical chamber 54 for a distance of approximately 1/16th of an inch, or to a distance that partially fills the second cylindrical chamber 54 but which avoids contact with the impeller 90. The volute plate 100 has ears 104 that are fittingly received by the recessed ears 64, and which have apertures 106 that matingly align with the apertures 66 that are located on planar surface 56. Located at the center of volute plate 100 is an aperture 108 that serves as the inlet port to the pump assembly 14. O-ring 110 is sized to fit around the lip 102 but will not enter the opening of the second cylindrical chamber 54, thus providing the means for a seal between volute plate 100 and the surface 56.

Next in the exploded view of FIG. 4 is intake screen 112, shaped similar to the volute plate 100. That is, the intake screen 112 has a cylindrical portion 114 and ear portions 116 protruding therefrom that are shaped so as to be fittingly received by the first cylindrical chamber 52 and the recessed ears 64 thereof, and when so placed, the flat surface 118 of intake screen 112 will be approximately flush or slightly recessed from the surface 28 of housing cover 18. Located through the ears 116 are apertures 120 that are aligned with apertures 106 of the volute plate and apertures 66 in surface 56. Surrounding apertures 120 are counterbore recesses 122 in the surface 114, sized to receive the head of the screw 124. As shown in FIG. 4, intake screen 112 has a plurality of openings 126 therethrough that collectively form a grid 128 which serves as a screen for the pump assembly 14.

To complete the description of the parts shown in exploded view in FIG. 4, attention is now directed to the upper lefthand corner of housing cover 18 as is drawn therein. The housing cover 18 has a recessed threaded aperture 130 which is surrounded by a relief recess 132. Oil plug 134 is an elastomeric nut having a threaded portion 136 that is threadingly engageable with the aperture 130. An O-ring 140 is passingly received by the threaded portion 136 and abuts on the underside of the head 138 of oil plug 134. The head 140 is clearingly received by the relief recess 132 and is sized so that the head 140 will be flush to or slightly recessed from surface 28 when oil plug 134 is tightly secured in aperture 130.

To this point in the discussion of the pump and motor assembly of the present invention, progress has been made to the point of describing those components shown in the exploded view of FIG. 4. A discussion of these components in assembled condition will be undertaken following a discussion along the same lines as above to describe the component elements of the motor assembly as shown in the exploded view of FIG. 5. This will permit a more complete discussion of the assembly once the components are completely identified.

Turning now to FIG. 5, shown therein is an exploded view of the components that make up the motor assembly 16 together with the housing cover 18 and the motor cover 20. Housing cover 18 has four mounting posts designated by the numerals 150 and 152. Each of these posts 150, 152 has a molded aperture 154 that extends longitudinally to and is blind ended in its respective post. Two of the mounting posts, 150, have a projecting sleeve 156 extending therefrom.

The drive shaft 160 has an impeller end 162 and a support end 166. The impeller end 162 has a diameter that is bearingly supported by the fixed bearing 74 located in end 62 of the third cylindrical chamber 58 of the volume chamber 50. Thrust washer 168 is made of steel and has an aperture 170 that is passingly received by the impeller end 162 of the drive shaft 160.

Interposed between the impeller end portion 162 and the support end 166 and attached to the drive shaft 160 is rotor 172. The rotor 172 need not be described in detail, as information thereof is readily available and will vary in construction according to the particular motor assembly selected. It is sufficient herein to state that the rotor 172 is receivable by the stator assembly shown as 174 in FIG. 5. For the present invention, a typical electrical rating of a selected motor assembly has a rotor approximately one and ⅛ inch in diameter and approximately 9/10 of an inch in length. The stack height of the stator assembly would be approximately ¾ of an inch and the motor assembly would be rated at one/one hundredth horse power, 2900 RPM, 42 watts, 7/10 amps on 110 volt service. While this electrical rating is given as an example of typical motor assemblies, the present invention is not limited to the dimensions selected for the pump or motor assembly, as it contemplates adaptability in a wide range of pump and motor assembly sizes. Thus stated, it nonetheless will be necessary for purposes of disclosure herein to describe the assembly of a preferred embodiment and, for that purpose, the description continues.

Stator assembly 174 has a stack 176 with apertures therethrough of 178 and 180. The apertures 178 align with the apertures 154 in the mounting post 150 and are sized to receive the sleeves 156 protruding therefrom. The sleeves 156, therefore, serve as locating dowel surfaces as the stator assembly 174 is positioned on the mounting posts 150 and 152.

The apertures 180 align with the apertures 154 in the mounting posts 152 when the stator assembly 174 is assembled to the mounting posts 150 and 152. The screw position of screws 182 are clearingly received through apertures 180 and are self-tapping to seat in apertures 154 of the mounting posts 152. Lock washers 184 are interposed between the screws 182 and the stator assembly 174.

The support end 166, as will be made clear below, is bearingly receivable by the bearing bracket 190 shown in FIG. 5 and in cross-section in FIG. 7. The bearing bracket 190 has a bracket portion 192 that is shaped with legs 194 so as to mount on the stator assembly 174 a clearing distance therefrom. Each of the legs 194 has an aperture 196 and sleeve 198. The apertures 196 are spaced so as to align with the apertures 178 of stator assembly 174 and the sleeves 198 are dimensioned with diameters receivable by apertures 178, thereby forming locating dowel surfaces on the bearing bracket 190 for relative positioning thereof with the stator assembly 174. The bearing bracket 190 has an axially alignable bearing 200 in the approximate center thereof. The bearing 200 is aligned next to an aperture 202 in the bearing bracket 190, but is restrained by its size from passing therethrough. The bearing 200 has an aperture 203 that has a diameter to bearingly receive support end 166 of drive shaft 160. As for bearing 200, it is made of material of the type recommended for the fixed bearing 74 in volume chamber 50. At the end of bearing 200 that is opposite to aperture 202, bearing 200 is held by a flexible assembly 204 that is connected to the bracket 192. This permits the axial center 206 to be angularly displaced with the flexure of the assembly 204. Such bearing brackets as described for bearing bracket 190 are commercially available, and the discussion herein has been given for a disclosure of the principle of the operation of such bearings.

To complete the discussion of the components shown in the exploded view of FIG. 5, mention here is made of the thrust washer 210 that has an aperture 212 pressingly receivable by the support end 166 of drive shaft 160. The purpose of thrust washer 210 is to adjust the end play of the drive shaft 160, and the thrust washer 210 is therefore usually made of an elastomeric material such as nylon. Also, mention is made of the retaining screws 182, equipped with lock washers 184, which pass through the apertures 196, the apertures 178, and self-tap the apertures 154 in the mounting posts 150 of housing cover 18.

Turning once more to FIG. 2, it can be seen by the partial cutaway view that the necessary outlet for the pump assembly 14 is provided by outlet port 220 which is a canal integrally molded with housing cover 18, the canal tangentially joining and entering volume chamber 50 through threaded nipple 222 extending from wall 19 and integrally formed with the housing cover 18.

Figure 8:
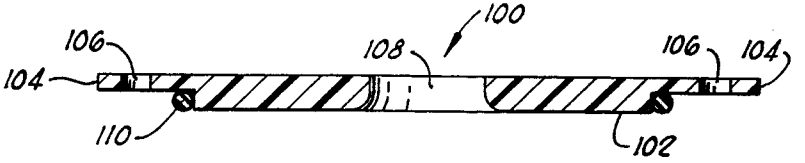
FIG. 8 is a partial plan view of the housing cover with a partial cutaway view showing the electric cord of the present invention.

Located near a corner of the housing assembly 12 and adjoining wall 19 is a conduit inlet 224 that has threaded aperture 226 communicating with the interior of housing assembly 12. This may best be seen in the partial cutaway view of FIG. 8. The aperture 226 is partially blocked at its inward end by shoulder 228. Shown in FIG. 8 is a portion of a molded electric cord 230 which has a molded plug 232 having a cylindrical portion 234 extensible through aperture 226 and a portion 236 that abuts against and is restrained by shoulder 228. Washer 238 is receivable by aperture 226 and abuts against the plug portion 236. Hollow, threaded plug 240 is threadingly receivable in aperture 226. The connections 242 are electrically connectable to the stator assembly 174.

Turning now to the assembly details of the present invention, the first step is to insert and securedly attach the molded electric cord 230 into inlet conduit 224 as shown in FIG. 8, and as described above. The cord 230 is then electrically connected to stator assembly 174. Next, referring to FIG. 5, the stator assembly 174 is mounted onto mounting posts 150, 152, and it is secured thereto at posts 152 by screws 182 placed through lock washers 184 and apertures 180. As the screws 182 are tightened into apertures 154 of posts 152, the screws self-tap these apertures. Next, drive shaft 160, with rotor 172, thrust washer 168, and thrust washer 210 affixed thereto, is put into place by passing impeller end 162 through apertures 76 of bearing 74 so that thrust washer 168 abuts against bearing 74. The thrust washer 168 is located on drive shaft 160 so that the rotor 172 is correctly positioned relative to stator assembly 174. This can also be observed by referring to FIG. 3. The bearing bracket 190 is mounted to stator assembly 174 with the support end 166 passing through the aperture 203 of bearing 200. The screws 182 are placed through the lock washers 184, apertures 196 of bracket 190, apertures 178 of stator assembly 174, and self-tappingly driven into the apertures 154 of the mounting posts 150. The thrust washer 210 is adjusted so as to clear the bearing 200.

Assembly of the exploded view of FIG. 5 is completed by securing motor cover 20 via screws 24 to housing cover 18 with O-ring 22 interposed therebetween.

Referring to the FIGS. 3 and 4, the pump assembly 14 is assembled by pressing the seal 80 into the third cylindrical chamber 58 and over the impeller end 162 of the drive shaft 160. Following this, the impeller 90 is pressed onto the impeller end 162 and situated into the second cylindrical chamber 54 so that the blades 90 thereof are rotatingly clearable to the planar surface 60 and, as will be clear, the blades 90 are also rotatingly clearable of the volute plate 100, which is now put in place with O-ring 110 into the first cylindrical chamber 52. The intake screen 112 is next placed over the volute plate 100 and secured via screws 124 which are passed through apertures 120, and apertures 106, and self-tappingly driven into apertures 66 in the volume chamber 50.

The housing assembly is now filled with a dielectric oil through the aperture 130 which is then sealed with the oil plug 134 and O-ring 138.

OPERATION OF THE EMBODIMENT OF FIGS. 1 THROUGH 8

In operation, the pump and motor assembly 10 is placed in a process liquid so that the pump assembly 14 is submersed. The electric cord 230 is connected to an electric power source, thereby energizing the stator assembly 174 and creating rotation of the rotor 172, which rotates the impeller 90. Liquid that enters the inlet port 108 through the intake screen 112 is forced by centrifugal force of the blades 96 toward the volute wall 70. The energy-laden fluid is then forced out of volume chamber 50 through the outlet port 220. The fluid is then forced through the nipple 222 which is connected as desired to a receiver conduit.

It is pointed out that the pump and motor assembly 10 may be placed onto any of its sides, with the exception of side 19, the coplanar edges 40 of ribs 38 serving to provide a level base thereto. When the pump and motor assembly 10 is placed on the posts 26 protruding from the surface 28 of the housing cover 18, the posts serve to hold the pump and motor assembly away from the supporting plane so that process liquid may freely enter the inlet screen 112, which serves to keep the volume chamber 50 free from debris or the like. The pump and motor assembly 10 may also be placed so as to rest on the surface 42 of the motor cover 20, the only requirement being that the process fluid be deep enough to enter the volume chamber 50.

As the rotor 172 rotates, heat is generated from the bearings 74, 200, and from the stator assembly 174. The dielectric oil-filling housing assembly 12 passes through the aperture 78 and has fluid communication thereby to both ends of the bearing 74. The rotation of the rotor 172 and drive shaft 160 causes the oil to be in continuous movement. Of course, vanes or the like may be added to these moving parts if required, but it has been found that this is not usually necessary in order to obtain good circulation of the oil. The heat dissipated from the oil-bathed working parts of the pump and motor assembly 10 is absorbed by dielectric oil. As the oil circulates, it continuously flows in contact with the volume chamber 50 that is extensive into the housing assembly 12; that is, the circulating oil has continuous heat transfer communication with the volume chamber 50. This creates a heat exchange relationship between the oil and process fluid being pumped by the pump assembly 14, with heat transfer being mostly effected through the volute wall 70. As is well known by heat transfer principles, the film resistance of the flowing process fluid is minimal, as the fluid is forced past the volute wall 70 at a high velocity. This, together with selected material so as to provide a heat conductive volute wall, creates a heat sink drawing heat from the dielectric oil in the housing assembly 12. Thus, the oil bathed parts, including all bearing surfaces, are cooled and lubricated, and are thereby given maximum operating life.

DESCRIPTION OF THE EMBODIMENT OF FIG. 9 AND FIG. 10

Figure 9:
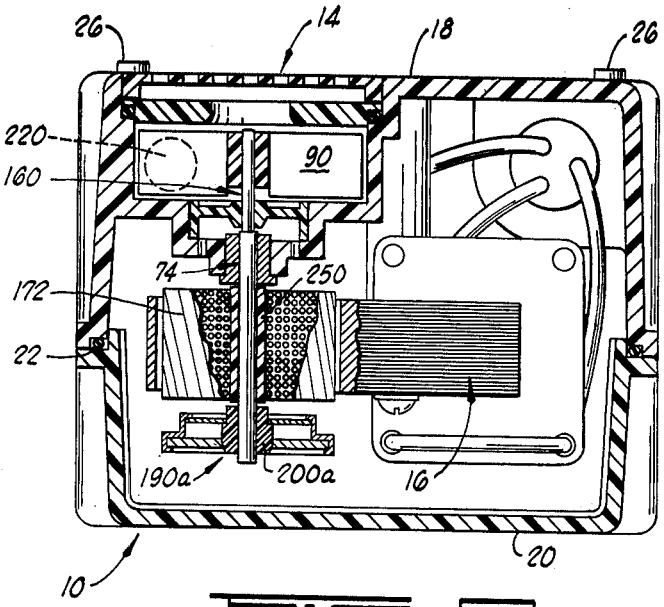
FIG. 9 is an alternate embodiment of the present invention wherein the pump and motor assembly has double insulation.
Figure 10:
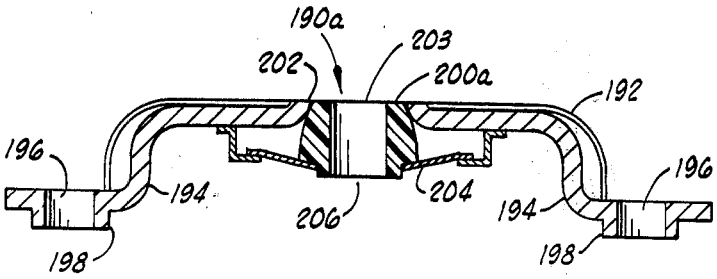
FIG. 10, similar to FIG. 7, shows in cross-section an alternate construction of the bearing bracket as required for providing double insulation for the pump and motor assembly of the present invention.

The embodiment represented by FIGS. 9 and 10 are exactly the same in construction and design as the embodiment above-described, with the exceptions that will hereafter be described in detail.

In FIG. 9, the rotor 172 is shown in partial cutaway fashion to disclose an insulating bushing 250 which is interdisposed betweenn the drive shaft 160 and the rotor. Bushing 250 is press-mounted onto drive shaft 160, and rotor 172 has a bore having a sufficient internal diameter to pressingly receive the bushing. As shown in FIG. 9, the length of bushing 250 may be established so as to just clear the bearing 74 and the bearing 200; the reason for this is to set the gap clearances between the bearings and the rotor 172. If this is done, the thrust bearings 168 and 210 may be eliminated.

The bushing 250 may be constructed of any durable, high-quality insulating material. In practice, acceptable bushings have been made of Fiberite 4009, a product of Fiberite Corporation, Winona, Minnesota, and of Ryton R4, a product of Phillips Petroleum Company, Bartlesville, Oklahoma.

Figure 7:
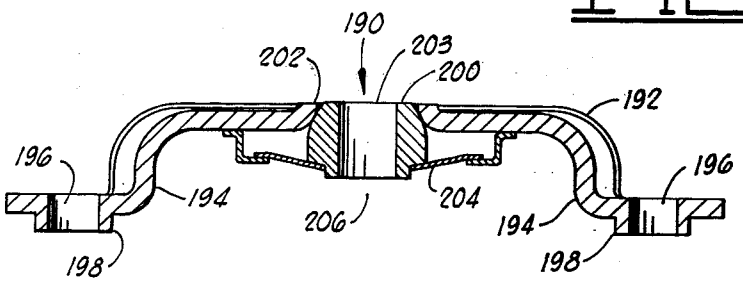
FIG. 7 is a cross-sectional view taken at 7—7 in FIG. 5.

FIG. 10 shows the completion of the double insulation of drive shaft 160 by the provision of a plastic bearing **200*a*, which is the only difference in the bearing bracket 190*a* and bearing bracket 190 of FIG. 7. As used herein, the word plastic refers to the large group of materials of high molecular weight, such as polymeric materials. The purpose of the plastic composition of the bearing, or the use of any other non-conductive material, is to electrically isolate bearing 200***a* from the rest of bracket 190. In practice, it has been found that the material mentioned above for the fabrication of bushing 250 is an adequate material for bearing 200*a*. Alternately, the same result of isolating drive shaft 160, relative to the bracket 190*a*, can be achieved by making bracket 190*a* from a plastic material. If this is done, bearing 200 can be fabricated as above described, or bearing 200*a* can be used.

In operation, it will be clear that drive shaft 160 is electrically insulated from each part of electric motor assembly 16. That is, drive shaft 160 contacts the following: impeller 90, which is preferably made of a plastic material of the same type as the housing cover 18; bearing 74, which is held by the elastomeric material of volume chamber 50; bushing 250; and bearing 200*a*, supported by bracket 190*a*.

An alternative construction to achieve the double insulating qualities described for the embodiment of FIGS. 9 and 10 is that of fabricating the drive shaft itself of an elastomeric material, a ceramic, or any other electrically non-conductive material having other suitable properties required for a drive shaft. The advantage of a drive shaft fabricated from such a material, in addition to achieving electrical isolation of electric motor assembly 16, would be that it would ahve uniformity of corrosion, as good corrosion characteristics is a property generally found in such materials. On the other hand, the advantage offered by the suggested insulating design of FIGS. 9 and 10 is the retention of a metal drive shaft while achieving electrical integrity of the unit.

The embodiment suggested herein offers the safest submersible pump achievable. Because of the extensive use of elastomeric materials in its construction, the pump and motor assembly can be contacted safely at any point on its external surfaces. The unit is normally grounded by the electric cord 230 (as shown in FIGS. 3 and 5). However, the complete isolation of electric motor assembly 16 from all possible stray electric leakage permits the elimination of the ground wire in many applications. This is possible because of the redundant design wherein electrical integrity is maintained, even should one of the insulators break down electrically. For example, should voltage be applied to drive shaft 160 through bushing 250, the drive shaft is still isolated from potential current draw throughout its length by its electrical isolation.

It is, therefore, seen that the present invention is well-adapted to carry out the objects and attain the ends and advantages mentioned as well as to achieve those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A pump and motor assembly, comprising:
- a housing assembly;
- a first bearing securedly connected to said housing assembly;
- a self aligning second bearing adjustably connected to said housing assembly and held in spatial relationship to said first bearing;
- a drive shaft rotatingly held by said first and second bearings;
- a volume chamber having a volute wall extending into said housing assembly;
- an impeller disposed within said volume chamber and connected to said drive shaft;
- motor means for rotating said drive shaft;
- seal means for providing a seal between said volume chamber and said drive shaft;
- inlet port means for providing fluid communication with said volume chamber; and,
- outlet port means for providing fluid communication with the volume chamber at a location removed from said inlet port means.

2. The pump and motor assembly as claimed in claim 1 wherein the motor means is enclosed within said housing assembly.

3. The pump and motor assembly as claimed in claim 2 wherein the housing assembly contains a coolant fluid that substantially surrounds the motor means.

4. The pump and motor assembly as claimed in claim 3 as further defined to include means for establishing coolant fluid communication within said housing assembly to both said first and second bearings to submerse said bearings in said coolant fluid.

5. The pump and motor assembly as claimed in claim 4 wherein the coolant fluid is a dielectric oil.

6. The pump and motor assembly as claimed in claim 5 wherein the volume chamber is molded of a material having a thermal conductivity of at least 1.4 BTU-inch per hour per square foot per degree Fahrenheit.

7. The pump and motor assembly as claimed in claim 6 wherein the housing assembly includes a housing cover, and said housing cover, said volume chamber, and said outlet port means are integrally molded of said material.

8. The pump and motor assembly of claim 1 wherein the motor means rotating said drive shaft is electrically insulated from said drive shaft.

9. The pump and motor assembly of claim 8 wherein the second bearing is a plastic bearing.

10. The pump and motor assembly of claim 9 wherein the impeller is made of an electrically non-conductive material.

11. The pump and motor assembly of claim 1 wherein the drive shaft is made from an electrically non-conductive material.

12. A pump and motor assembly, comprising:
- a molded housing assembly;
- a volume chamber having a volute wall and an interior wall formed integrally with said housing, said volute wall and interior wall disposed within said housing;
- a fixed bearing securedly connected to said interior wall;
- an aligning bearing connected to said housing assembly and held thereby in spatial relationship to said fixed bearing;
- a drive shaft passing through and bearingly supported by said fixed and adjusting bearings;
- an impeller disposed within said volume chamber and connected to said drive shaft;
- motor means for providing a seal between said volume chamber and said drive shaft;

seal means for providing a seal between said volume chamber and said drive shaft;

inlet port means for providing fluid communication with said volume chamber; and, outlet port means for providing fluid communication with said volume chamber at a location removed from said inlet port means.

13. The pump and motor assembly as claimed in claim 8 wherein the housing assembly is substantially filled with a lubricating coolant fluid.

14. The pump and motor assembly as claimed by claim 9 further defined to include means for establishing coolant fluid communication within said housing assembly to both first and second bearings to submerse said bearings in said coolant fluid.

15. The pump and motor assembly as claimed in claim 10 wherein the coolant fluid is a dielectric oil.

16. The pump and motor assembly as claimed in claim 15 wherein the housing and volume chamber are made of a material having a thermal conductivity of at least 1.4 BTU-inch per hour per square foot per degree Fahrenheit.

17. The pump and motor assembly as claimed in claim 16 wherein the housing assembly includes a housing cover, and said housing cover, said volume chamber, and said outlet port means are integrally molded of the same material.

18. The pump and motor assembly as claimed in claim 17 wherein said interior wall of said volume chamber is molded about said fixed bearing.

19. The pump and motor assembly of claim 8 wherein the motor means rotating said drive shaft is electrically insulated from said drive shaft.

20. The pump and motor assembly of claim 9 wherein the second bearing is a plastic bearing.

21. The pump and motor assembly of claim 10 wherein the impeller is made of an electrically non-conductive material.

22. The pump and motor assembly of claim 12 wherein the drive shaft is made from an electrically non-conductive material.

23. A pump and motor assembly, comprising:

a molded housing assembly;

a volume chamber having a volute wall and an interior wall formed integrally with said housing, said volute wall and interior wall disposed within said housing and molded of the same material as the housing assembly;

a drive shaft;

a fixed bearing securedly connected to said interior wall and bearingly supporting said drive shaft; aligning bearing means bearingly supporting said drive shaft at a location removed from said fixed bearing, said aligning bearing means electrically insulated from said drive shaft;

an impeller disposed within said volume chamber and connected to said drive shaft;

electric motor means disposed within said housing for rotating said drive shaft;

seal means for providing a seal between said volume chamber and said drive shaft;

inlet port means for providing fluid communication with said volume chamber; and, outlet port means for providing fluid communication with said volume chamber at a location removed from said inlet port means.

* * * * *